US009482052B2

(12) United States Patent
Sousa et al.

(10) Patent No.: US 9,482,052 B2
(45) Date of Patent: Nov. 1, 2016

(54) SAFETY GATE WITH A REWINDABLE, FLEXIBLE BARRIER

(71) Applicant: SUMMER INFANT (USA), INC., Woonsocket, RI (US)

(72) Inventors: Mark J. Sousa, Hope, RI (US); David L. Baker, Cumberland, RI (US); William A. Henderson, Holden, MA (US)

(73) Assignee: Summer Infant (USA), Inc., Woonsocket, RI (US)

( * ) Notice: Subject to any disclaimer, the term of this patent is extended or adjusted under 35 U.S.C. 154(b) by 0 days.

(21) Appl. No.: 14/848,493

(22) Filed: Sep. 9, 2015

(65) Prior Publication Data

US 2015/0376942 A1 Dec. 31, 2015

Related U.S. Application Data

(63) Continuation-in-part of application No. 13/961,183, filed on Aug. 7, 2013, now abandoned.

(51) Int. Cl.

| | |
|---|---|
| ***E06B 9/11*** | (2006.01) |
| ***E06B 11/02*** | (2006.01) |
| ***E01F 13/02*** | (2006.01) |
| ***E06B 9/08*** | (2006.01) |
| *E06B 9/00* | (2006.01) |

(52) U.S. Cl.

CPC ..... *E06B 11/026* (2013.01); *E01F 13/028* (2013.01); *E06B 9/08* (2013.01); *E06B 2009/002* (2013.01)

(58) Field of Classification Search

CPC ..... E06B 2009/002; E06B 11/026; E06B 2009/807; E06B 2009/808

USPC ..... 160/24, 370.22, 296, 301, 302, 303, 160/305, 323.1

See application file for complete search history.

(56) References Cited

U.S. PATENT DOCUMENTS

| | | | | |
|---|---|---|---|---|
| 5,036,898 | A | 8/1991 | Chen | |
| 5,054,533 | A | 10/1991 | Lii | |
| 5,205,322 | A | 4/1993 | Lii | |
| 5,226,467 | A | 7/1993 | Lii | |
| 6,155,328 | A | 12/2000 | Welfonder | |
| 6,435,250 | B1 | 8/2002 | Pichik | |
| 6,536,502 | B2 | 3/2003 | Britto | |
| 6,575,435 | B1 | 6/2003 | Kotzen | |
| 6,591,890 | B1 | 7/2003 | Grubb | |
| 6,749,142 | B2 * | 6/2004 | Arisaka | B60R 5/047 160/296 |
| 6,907,914 | B1 | 6/2005 | Lundh | |
| 7,178,792 | B2 | 2/2007 | Monahan et al. | |
| 7,185,694 | B2 | 3/2007 | Dunn | |
| 7,219,709 | B1 | 5/2007 | Williams | |
| 7,438,112 | B2 | 10/2008 | Cheng | |
| 8,191,604 | B2 | 6/2012 | Wang | |
| 8,261,806 | B2 | 9/2012 | Wettern | |
| 2011/0088323 | A1 | 4/2011 | Lundh | |

FOREIGN PATENT DOCUMENTS

| | | |
|---|---|---|
| WO | WO9400664 | 1/1994 |
| WO | WO2010070078 | 1/2010 |

* cited by examiner

*Primary Examiner* — David Purol

(74) *Attorney, Agent, or Firm* — Chace Ruttenberg & Freedman, LLP

(57) ABSTRACT

Provided is a retractable safety gate and locking mechanism for a retractable safety gate that employs a flexible barrier windable around a rotating spool, a lever or time release cap, a spline lock, meshing teeth, a spline geometry for extending and retracting the barrier.

9 Claims, 7 Drawing Sheets

19
13
16
14
11
15
18
22
17
2
2
26
24
27
7
25
5
21
4
1
3

SAFETY GATE WITH A REWINDABLE, FLEXIBLE BARRIER

RELATED APPLICATIONS

This application is a continuation-in-part of, and claims the benefit of, U.S. Ser. No. 13/961,183 filed Aug. 7, 2013.

INVENTION FIELD

The invention relates to safety gates and to lock release mechanisms for safety gates, more particularly to safety gates having flexible, retractable barriers.

BACKGROUND

Retractable safety gates composed of flexible barrier sheets and winding mechanisms are known. One example is disclosed in PCT patent publication WO94/00664, in which a roll of flexible sheet material is disposed in a housing that is vertically mounted to one side of a passageway. When the sheet material is extended across the passageway, it is received and releasably held by another housing mounted to the opposite side of the passageway. To accommodate passageways of varying widths, the barrier sheet will often be longer than the passageway it extends across. Consequently, a lock mechanism must be provided to prevent over-extension of the barrier once in position in the passageway. PCT patent publication WO94/00664 discloses a lock mechanism that is composed of a plate and a key pin that is introducible into a selected one of a plurality of locking holes in the plate. U.S. Pat. No. 7,219,709 discloses a retractable safety gate having a spring-loaded ratchet and pawl mechanism to lock the barrier in the extended position. U.S. Pat. No. 7,178,792 discloses adjustable width safety gate having an electrically operable locking mechanism. U.S. Pat. No. 6,907,914 discloses a rotating catch wheel that cooperates with a pinned driver locking and unlocking mechanism for a safety gate. U.S. Pat. No. 6,435,250 discloses a retractable safety gate having a clutch and stop mounted on a spool for locking the barrier in its extended position. U.S. Pat. No. 5,690,317 discloses a retractable safety gate having a spring mounted roller mechanism that is automatically locked against rewinding of the barrier by means of a ratchet and pawl mechanism. United States Patent Publication No. 2011/088323 discloses a retractable safety gate locking mechanism that is composed of a release wheel including a cylinder and a cam, a spring-loaded lock actuator movable by rotation of the cam, a toothed member that engages and disengages with the lock actuator, and a timer operatively connected to the release wheel.

INVENTION SUMMARY

A retractable safety gate composed of a flexible barrier and a releasable locking mechanism is provided. The gate itself is composed of a flexible barrier sheet windably disposed about a substantially hollow spool and capable of extension from and retraction onto the spool. The winding spring is operatively connected to the bottom end of the spool. The winding spring applies continuous torque on the spool and is able to retract the barrier when in its extended position across a passageway. At the other, uppermost, end of the spool is a cap mounted on the spool in a sealed manner and comprising the locking mechanism. Two embodiments of the locking mechanism are provided. In the first embodiment, the interior of the cap is formed with interiorly disposed angular teeth that extend downward vertically and the top of the cap has an opening in which a lock release, in the form of a depressible button, is disposed. In the second embodiment, instead of a depressible button, a lever is operatively connected to a compression spring through a cam, both of which are is positioned within the cap.

In the first embodiment within the cap, a cylindrical spline lock is rotatably attached to the top of the spool. The spline lock is formed with an angular toothed surface disposed and arranged to engage and disengage with the cap teeth to prevent rotation in one rotational direction and permit rotation in the opposite rotational direction. A spline geometry is disposed within or atop the uppermost portion of the spool and is operatively connected with the spline lock to move the spline lock axially in relation to the spool with the application of pressure on the lock release. Time delay means comprising a compression spring is positioned within the cap and surrounding the spline lock and a one-way air check valve is mounted in the spline lock so that when the compression spring is compressed by a force imposed on the lock release, air is forced through the check valve and blocks airflow into the cap when the force on the lock release and compression spring is removed. In the second embodiment, the cylindrical spline lock is rotatably attached to the top of the spool and is formed with a circumferential toothed outer edge that engages and disengages with housing teeth mounted on a stationary bracket 38 and positioned within the cap. The spline geometry is disposed within or atop the uppermost portion of the spool and is operatively connected with the spline lock to allow the movement of the spline lock axially in relation to the spool. The spline lock is forced upward and away from the housing teeth by a compression spring mounted beneath it. A lever actuated cam mechanism is mounted above the spline lock and limits the motion on the spline lock. As the lever actuated cam mechanism rotates, it pushes the spline lock downward to engage the teeth to lock the spool. When the lever actuated cam mechanism is rotated in the opposite direction, it allows the spline lock to move upward, separating the housing teeth from the toothed outer edge of the spline lock and allowing the spool to rotate.

The mechanism is intended for use in a retractable safety gate, and a retractable safety gate is also provided. The gate includes two gateposts and a flexible barrier sheet that is extensible between the two gateposts and windably disposed about a substantially hollow spool. The gate includes the locking mechanism as defined above that is mounted on the uppermost portion of the spool in an engaged manner. The spool and locking mechanism are disposed within a housing that has a longitudinal slit for permitting extension and retraction of the barrier sheet within the housing and about the spool. The housing is slidably mountable on one of the gateposts. The extending edge of the barrier sheet is formed with an engagement head and the other gatepost is formed to removably receive the engagement head to temporarily position the barrier across the passageway. The spline lock teeth and the cap teeth are angularly formed such that they act in one direction only but allow for movement in the opposite direction. In the first embodiment, the teeth are kept engaged by means of the lock spring that continuously applies an upward force onto the spline lock, which restricts the spool from unwinding. In the second embodiment, the teeth are kept engaged by means of the lever, a cam mechanism, and the compression spring, which keeps the cam and spline lock in contact at all times.

In the first embodiment, when the lock release is pressed by the user, the compression spring compresses and pushes downward the spline lock, which disengages the spline lock teeth from the cap teeth. There is a body of air between the lock release and the cap that is a substantially sealed volume that compresses when the lock release is depressed. The volume of air is forced through the air check valve that is mounted in the spline lock. The air check valve allows the air to flow outside the sealed volume and displace the lock release rapidly but does not allow air to flow back in. When the force on the lock release is removed by the user, the compression spring pushes upward on the lock release and spline lock, creating a vacuum within the substantially sealed volume. Air flow into this vacuum is modulated by the dimensions of one or more spaces between the components in the housing and/or through the other components. This flow of air restricts the movement of the lock release and spline lock and slows their movement as they move back to their locked positions in which the angular teeth of the spline lock engage with the angular teeth of the cap interior. The amount of time it takes to translate back into their locked positions creates a time delay. Friction between the translating and fixed components of the mechanism adds to the time delay.

In the second embodiment, when the release lever is actuated to the upward or open position by the user, the compression spring pushes upward on the spline lock. This movement releases or disengages the meshing teeth from each other which allows the barrier to retract. When the lever is moved to the downward or closed position, the cam attached to the lever rotates and pushes the spline lock downward, which engages the spline lock teeth with the cap teeth. The engagement of the spline lock teeth and cap teeth with each other prevents the spool from rotating and locks the barrier in place across the passageway.

DETAILED DESCRIPTION

Figure 1:
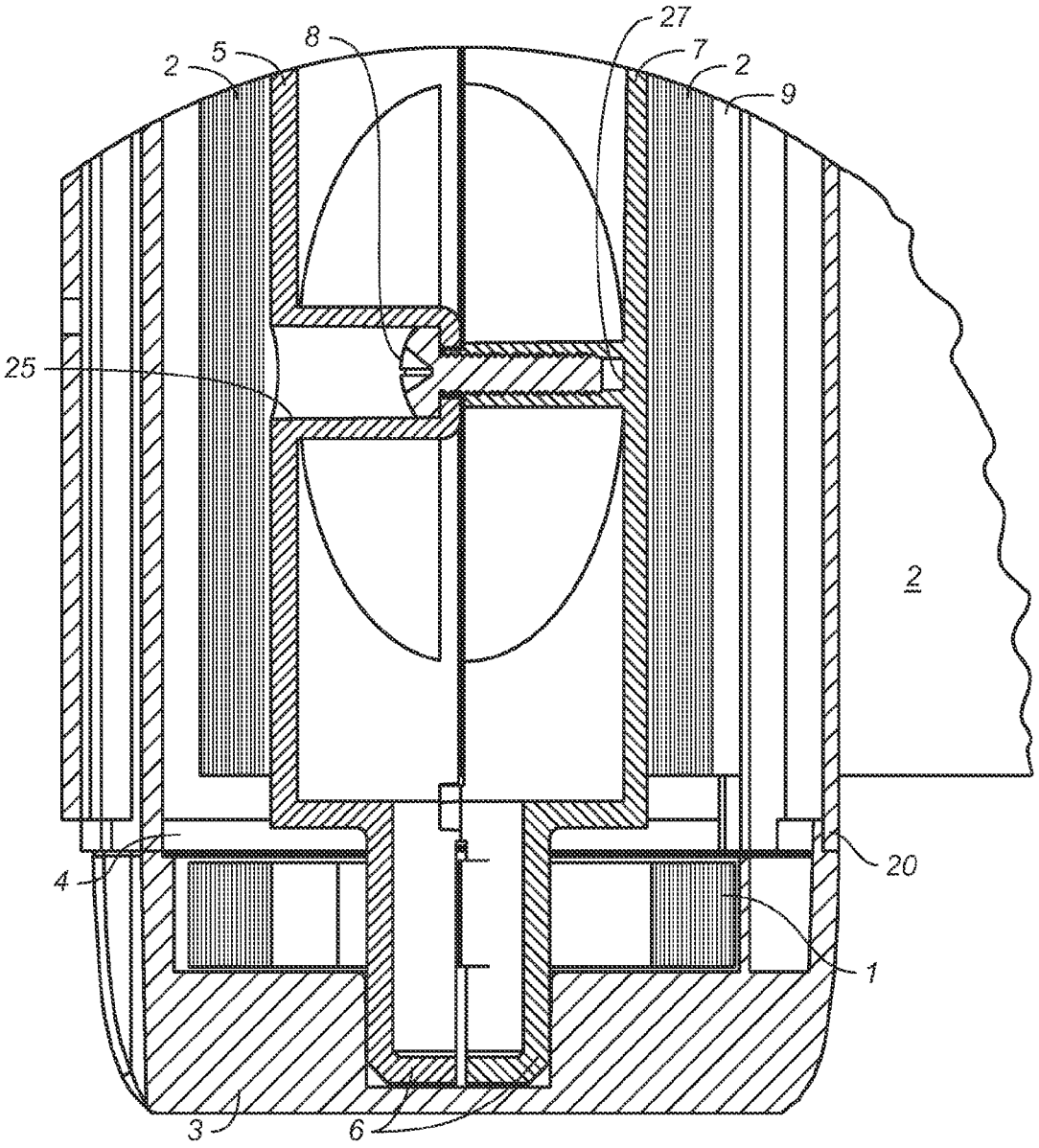
FIG. 1 is a cross section view of the bottom of the spool of the safety gate of the invention.

Referring now to FIG. 1, there is illustrated the bottom portion of the safety gate in cross section. Spool halves, 5 and 7, have a series of mating holes, 25 and 27, arranged longitudinally from the top of the spool halves to the bottom of the spool halves (see also FIG. 4). The spool halves are connected to each other by connecting means 8. Connecting means 8 may by pins, rivets, screws and the like which are inserted into holes 25 and 27 to keep spool halves 5 and 7 together. The means by which the two halves are connected together is not critical and any suitable means will do. Alternatively, the spool may be formed as a single unitary piece—either a solid or a hollow tube. At the bottom end of the spool, the two spool halves, 4 and 7, terminate in spool stub 6. Spool stub 6 may be formed as a unitary piece of spool halves 5 and 7. Flexible barrier, 2, is provided and forms the portion of the safety gate that extends to stretch across a passageway. If the spool is formed of two mating pieces, one longitudinal edge of the barrier, 2, for the gate can be sandwiched between the two halves before the connecting means is inserted in the mating holes. If the spool is formed of a unitary piece, the longitudinal edge of the barrier must be affixed to the spool in another manner, by glue, tape or the like.

Winding spring cover 3 is formed to receive spool stub 6 and seat the stub by means of spool seat 4. Winding spring cover 3 is also formed to receive a winding spring, 1, which is formed with a central bore through which spool stub 6 extends. Winding spring 1 forms part of the releasable and retractable lock mechanism of the invention.

Figure 4:
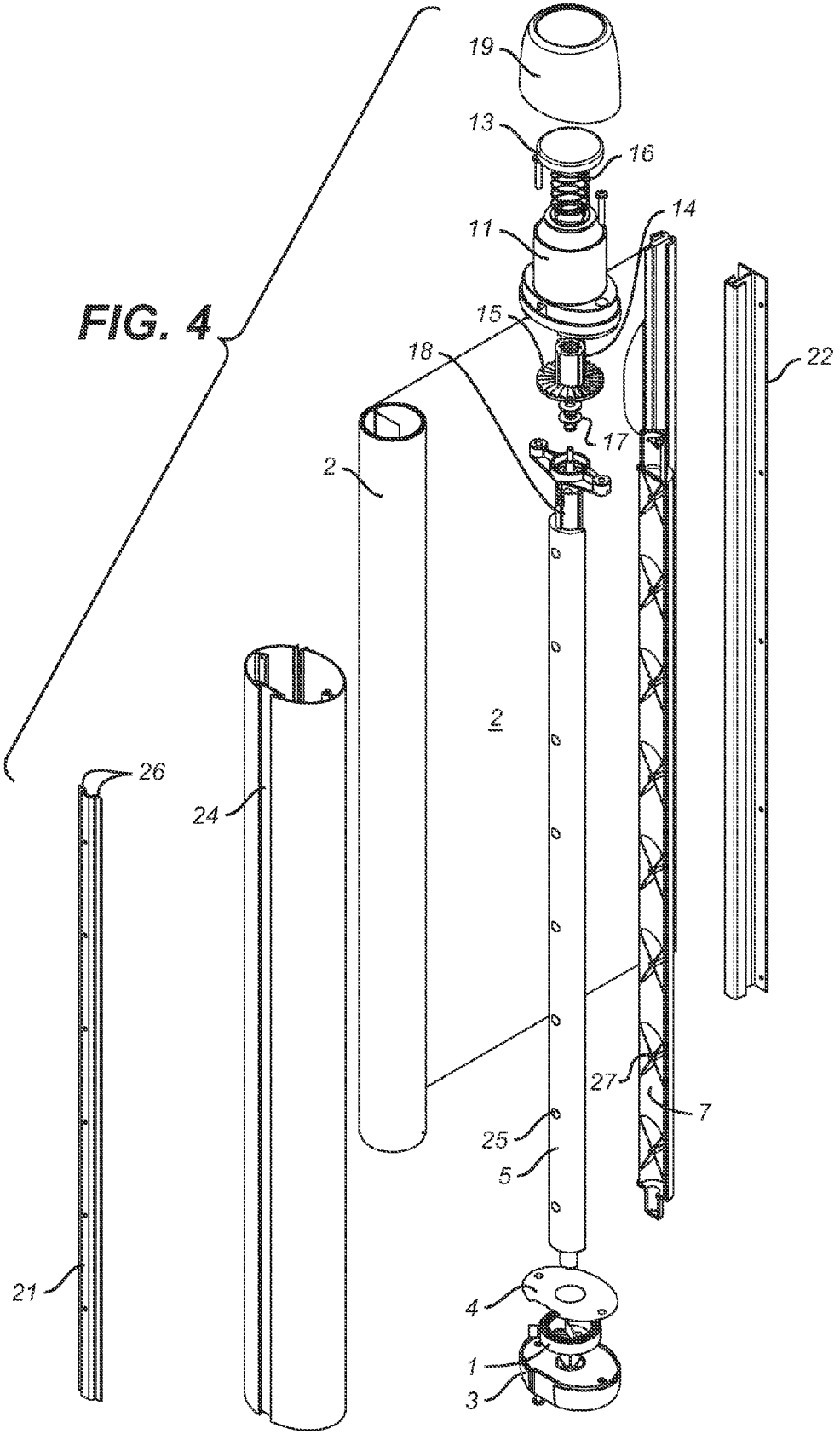
FIG. 4 is an expanded perspective view of the safety gate of the invention.
Figure 5:
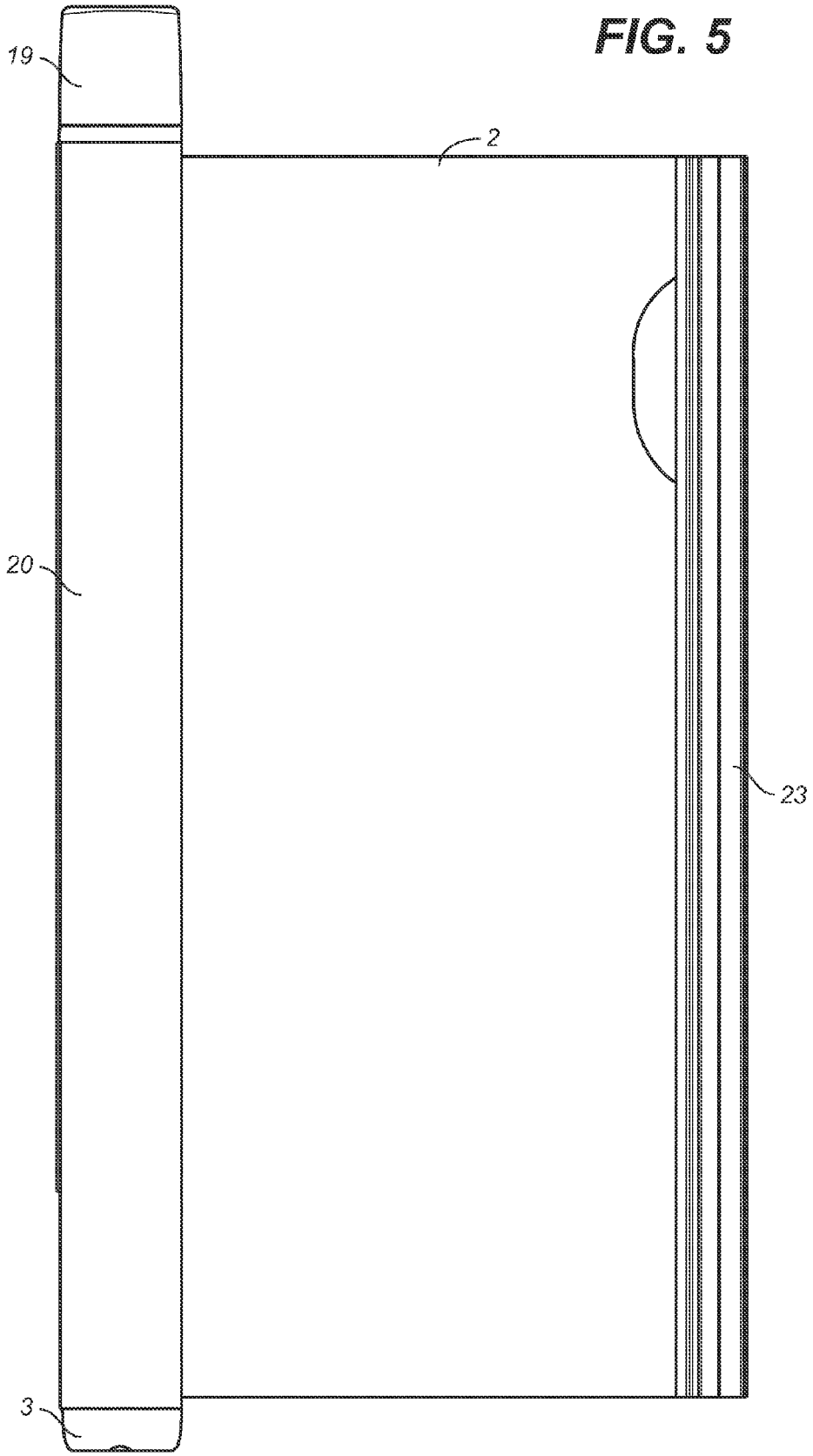
FIG. 5 is a plan view of the safety gate of the invention, with the barrier extended from its housing.
Figure 6:
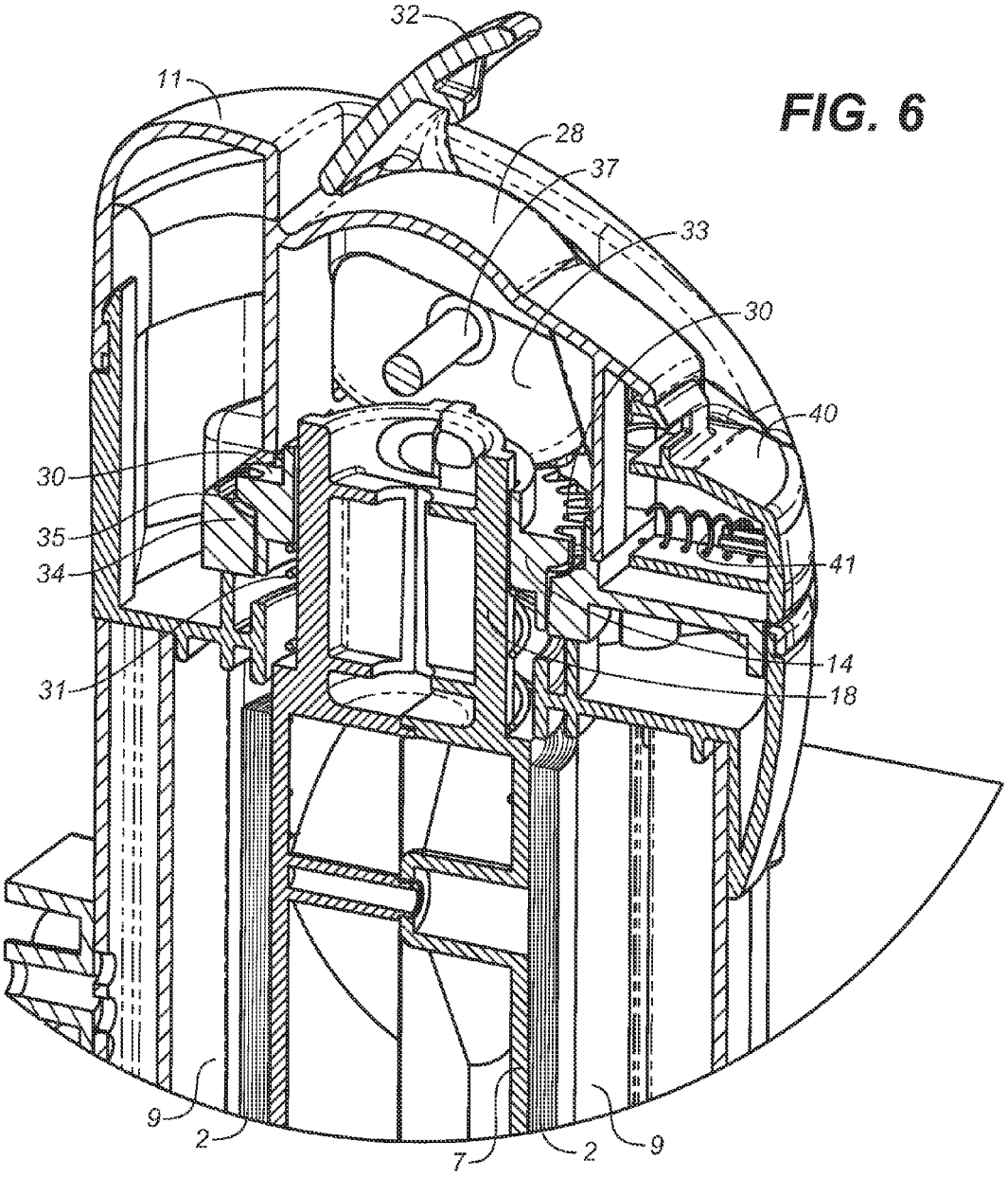
FIG. 6 is an isometric view of another of the embodiments of the locking mechanism of the invention.
Figure 7:
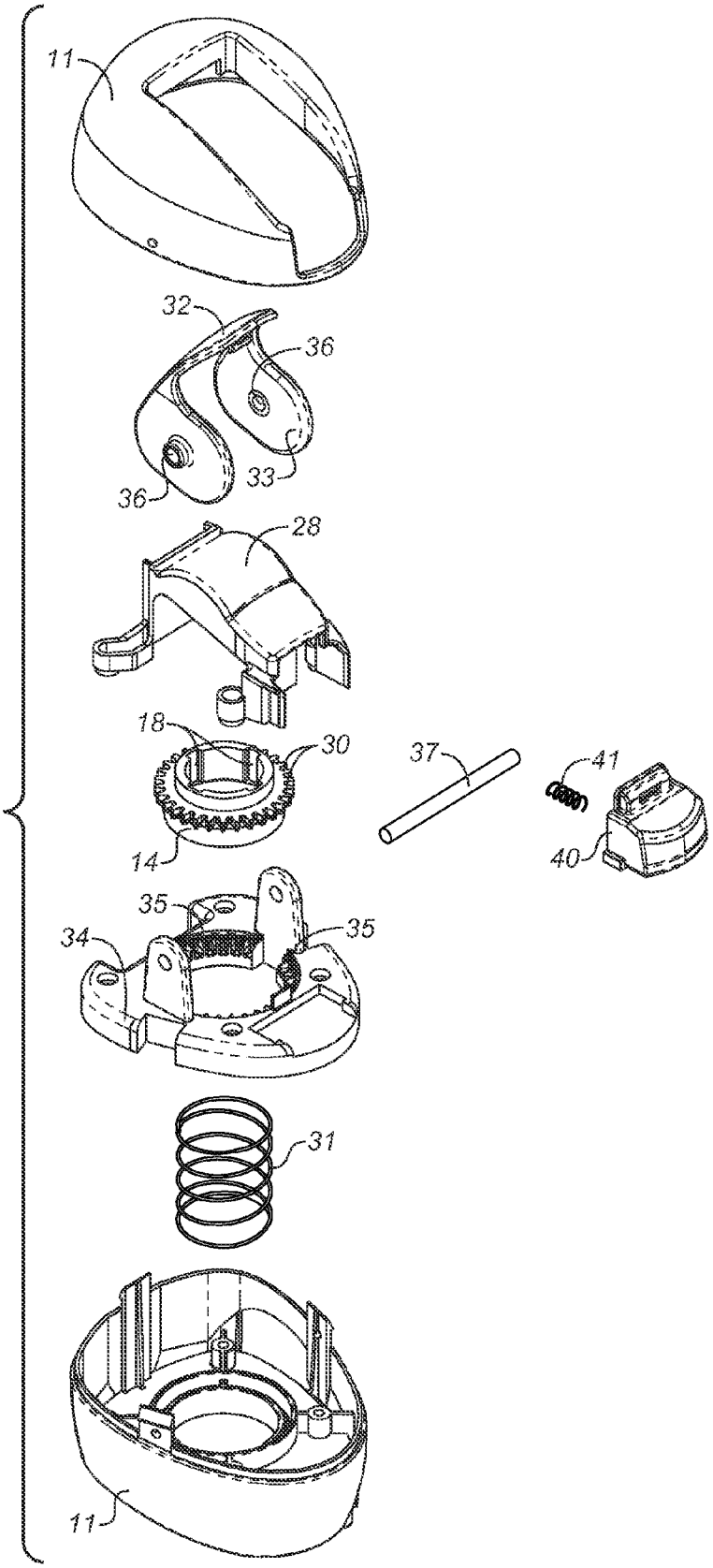
FIG. 7 is an expanded perspective view of the locking mechanism shown in FIG. 6.

Referring now to FIGS. 4 and 5, the safety gate of the invention further includes two gateposts, 21 and 22, mountable on the opposing walls of a passageway and flexible barrier sheet 2 that is extensible between the two gateposts and windably disposed about the spool. The gate includes a locking mechanism as defined below that is mounted on the uppermost portion of the spool in an engaged manner. (One embodiment of the lock mechanism is illustrated in FIG. 4. Another embodiment is illustrated in FIGS. 6-7.) The spool is disposed within a spool housing 20 that has a longitudinal slit for permitting extension and retraction of the barrier sheet 2 within the housing and about the spool. In a position on the spool housing preferably opposite the slit are gatepost engagement means 24. As shown in FIG. 4, gatepost engagement means is a top to bottom extending vertical channel 24. Gatepost 21, which is wall mountable, is formed with flanges 26 that are received within channel 24 although other means of engagement between the spool housing, 20, and the gatepost, 21, can be readily envisioned by those of skill in the art. The spool housing, 20, the winding spring cover, 3, positioned below the spool housing, and a top cap housing, 19, positioned above the spool housing may be formed so as to create a substantially smooth and contiguous outer surface of the safety gate. The extending edge of the barrier sheet is formed with an engagement head, 23, and a second, wall mountable, gatepost, 22, is formed to removably receive engagement head 23 to temporarily and releasably position the barrier across the passageway. In the embodiment shown in FIG. 4, engagement head 23 snap clicks into gatepost 22 in a manner know in the art.

Figure 2:
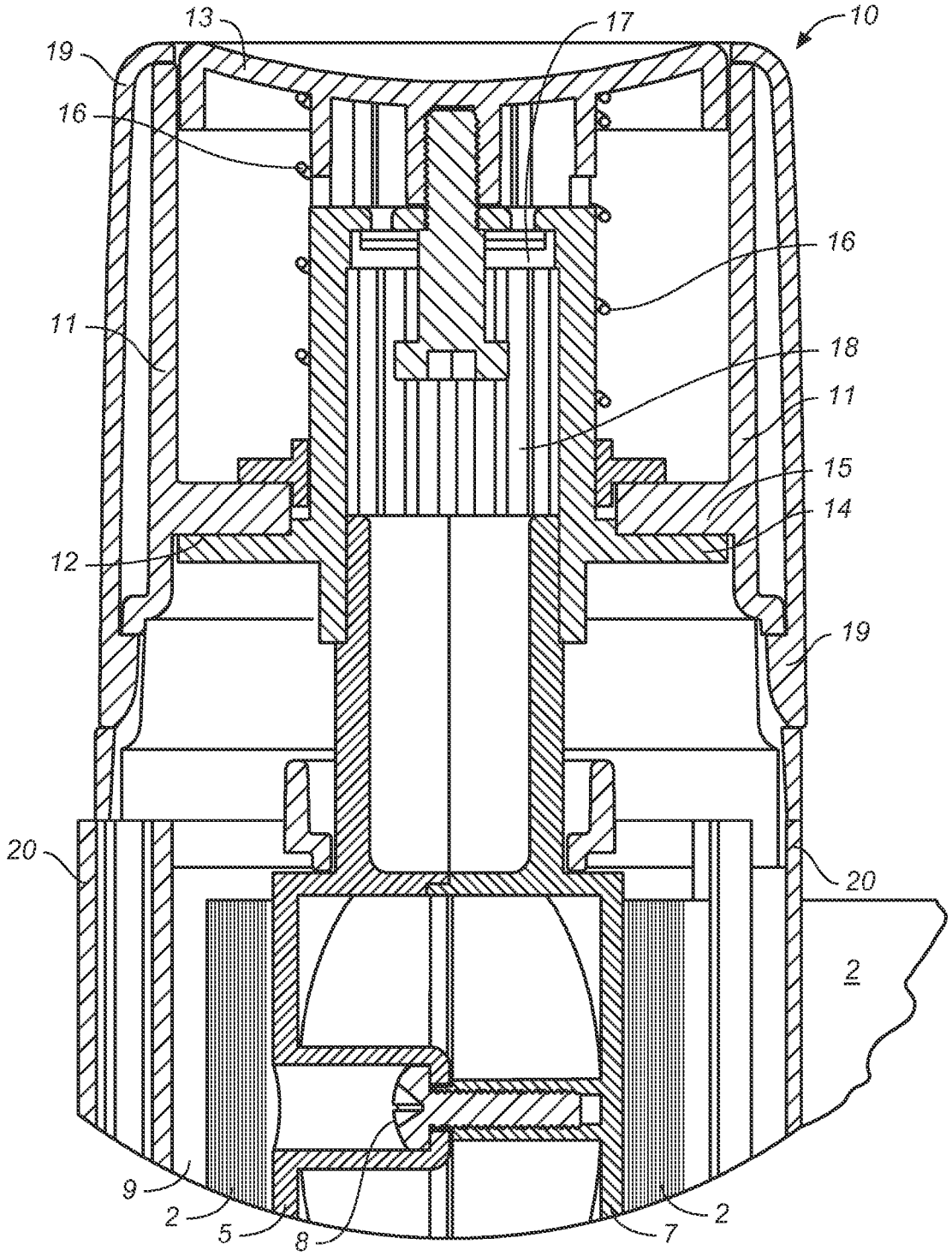
FIG. 2 is a cross section view of the locking mechanism of the invention.
Figure 3:
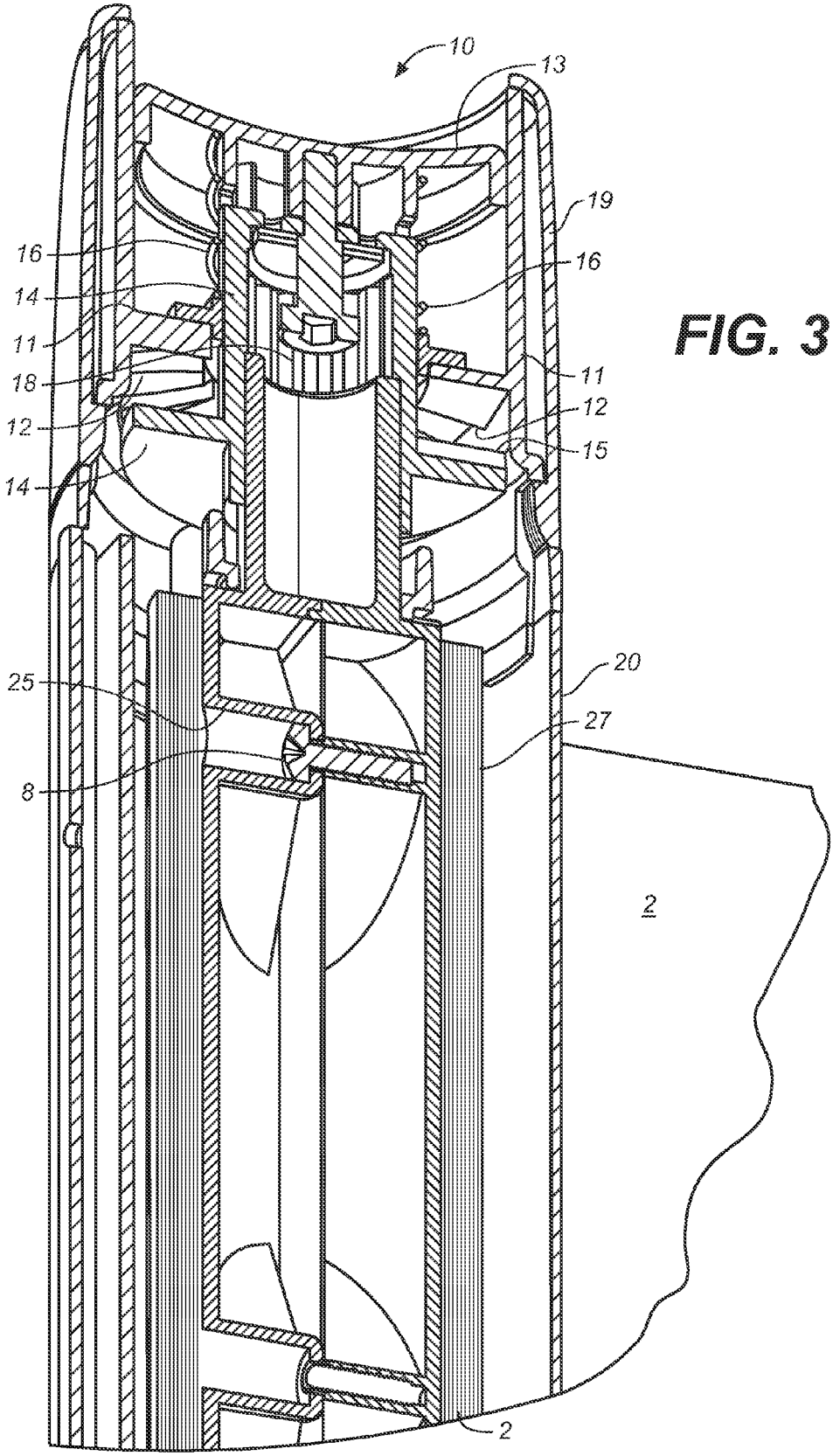
FIG. 3 is an isometric view of one of the embodiments of the locking mechanism of the invention.

FIGS. 2 and 3 illustrate the first embodiment of the rest of the releasable lock mechanism 10 of the invention. At the uppermost, end of the spool is a top cap, 11, mounted on the spool in a sealed manner. The interior of the top cap, 11, is formed with interiorly disposed angular cap teeth 12 that extend downward vertically and the top of the top cap has an opening in which a lock release, 13, in the form of a depressible button, is disposed.

Within the top cap 11, a cylindrical spline lock, 14, is rotatably attached to the top of the spool. The spline lock 14 is formed with an angular toothed surface, 15, disposed and arranged to engage and disengage with the interiorly disposed angular cap teeth 12 to prevent rotation in one rotational direction and permit rotation in the opposite rotational direction. A spline geometry, 18, is disposed within or mounted on the uppermost portion of the spool and is positioned within the spline lock and is operatively connected with it to move the spline lock axially in relation to the spool with the application of pressure on the lock release. A compression spring, 16, which forms part of the time delay means, is formed and positioned to surround spline lock 14 and spline geometry 18 and is engagable by lock release 13. A one-way air check valve (best seen in FIG. 2), 17, is mounted in the interior of spline lock 14 so that when the compression spring is compressed by a force imposed on lock release 13, air is forced through the check valve and blocks airflow into the cap when the force on the lock release and compression spring is removed.

The lock mechanism, 10, including top cap 11, is positioned within the top cap housing, 19, such that lock release 13 is depressible within the top cap housing. The spline lock teeth, 15, and the cap teeth, 12, are angularly formed such that they act in one direction only but allow for movement in the opposite direction. The teeth are kept engaged by means of the compression spring, 16, that continuously applies an upward force on the spline lock, 14, which restricts the spool from unwinding.

When lock release 13 is pressed by the user, compression spring 16 compresses and pushes spline lock 14 downward, which disengages the spline lock teeth, 15, from the cap teeth, 12. There is a body of air between the lock release, 13, and the top cap, 11, that is a substantially sealed volume that compresses when the lock release is depressed. The volume of air is forced through the air check valve, 17, that is mounted in the spline lock. The air check valve allows the air to flow outside the sealed volume and displace the lock release rapidly but does not allow air to flow back in. When the force on lock release 13 is removed by the user, compression spring 16 pushes upward on the lock release and spline lock 14, creating a vacuum within the substantially sealed volume. Air flow into this vacuum is modulated by the dimensions of one or more air spaces, 9, between the components in the housing and/or through the other components. This flow of air restricts the movement of the lock release and spline lock and slows their movement as they move back to their locked positions in which the angular teeth of the spline lock engage with the angular teeth of the cap interior. The amount of time it takes to translate back into their locked positions creates a time delay. Friction between the translating and fixed components of the mechanism adds to the time delay.

FIGS. 6 and 7 illustrate a second embodiment of the releasable lock mechanism. Inside cap 11, cylindrical spline lock, 14, is rotatably attached to the top of spool halves 5 and 7. The spline lock, 14, is mounted on a spline geometry, 18, which is disposed within the uppermost portion of the spool and is operatively connected to it to allow the movement of the spline lock axially in relation to the spool. (The spline geometry has male and female portions, male portion 18 is shown in FIG. 6 and is mounted on the spool ends. Female portion 18 is formed as four integral, spaced-apart, inner indentations of the spline lock as can be seen in FIG. 7.) The spline lock, 14, is formed with a toothed outer edge, 30, disposed and arranged around the circumference of the spline lock. Also inside the cap is a stationary spline lock bracket, 34, that is mounted on cap 11. The bracket is formed with circumferential bracket teeth, 35, on the central and inner surface of bracket 34. Teeth 35 are able to engage with the toothed outer edge, 30, of the spline lock to prevent rotation of the spool and to disengage with the toothed outer edge of the spline lock to allow rotation of the spool. A compression spring, 31, is disposed and arranged below the spline lock bracket, 34, within the cap. The spline lock is forced upward and away from bracket teeth 35 at all times due to the compression spring mounted beneath it. A spline lock cover, 28, is mounted above the spline lock and below the top of cap 11. Extending through a hole in cap 11 is a lever actuated cam mechanism consisting of a lever, 32, an integral cam, 33, that consists of two lobes extending angularly from the lever, 32, and lever pivot 37, which extends through a pair of centrally disposed holes, 36, in the cam lobes. Lever pivot 37 is disposed below spline lock cover 28 as can best be seen in FIG. 7. The lever actuated cam mechanism limits the motion on the spline lock by means of cam surface 33, which is in contact with the spline lock. As the lever is raised, cam surface 33 is rotated in the opposite direction, allowing the spline lock to move upward and the bracket teeth, 35, to separate from the toothed outer edge, 30, of the spline lock. This frees the rotational movement of the spool. As the lever is lowered, cam 32 rotates pushing the spline lock downward and engaging the bracket teeth, 35, with the toothed outer edge, 30, of spline lock 14, thereby locking the spool and preventing its rotation. As an added security feature, a secondary lock button, 40, and a spring, 41, are mounted on stationary spline lock bracket 34 and extend through the hole in the top of cap 11. This extra lock can be engaged by pressing down on lock button 40 once the lever is lowered. To disengage it, the user presses lock button 40 and lifts up lever 32 manually.

To use the safety gate of the invention, the user mounts gate posts 21 and 22 in the desired passageway (or doorway) so that they extend vertically up the walls and are positioned more or less across from each other. Next, the user slides spool housing 20 onto gate post 21. At this point, the barrier sheet is fully wound around the spool and only barrier sheet engagement head is outside of the spool housing. The user then pulls barrier sheet across the passageway and engages it with gate post 22 on the opposed side of the corridor. The engaged angular spline lock and cap teeth in the first embodiment, or the engaged toothed edge of the spline lock and the housing teeth in the second embodiment, maintain the barrier in an unmovable position such that the barrier cannot be extended from the spool further if a pressure is applied to the barrier. In the first embodiment, to disengage the barrier, the user applies a downward force on the lock release button. When the lock release is pressed, the compression spring compresses and pushes downward the spline lock, which disengages the spline lock teeth from the cap teeth. The substantially sealed volume of air between the lock release and the cap compresses and the volume of air is forced through the air check valve that is mounted in the spline lock. The air check valve allows the air to flow outside the sealed volume and displace the lock release rapidly but does not allow air to flow back in. When the force on the lock release is removed by the user, the compression spring pushes upward on the lock release and spline lock, creating a vacuum within the substantially sealed volume. The rate of air flow back into this vacuum is dependent on and modulated by the dimensions of one or more spaces between the components in the housing, particularly the air gap between spool and the spool housing, and/or through the other components. This flow of air slows the movement of the lock release and spline lock as they move back to their locked positions in which the angular teeth of the spline lock engage with the angular teeth of the cap interior. Friction between the translating and fixed components of the mechanism adds to the time delay. In the second embodiment, to disengage the barrier, the user pulls upward on the lever to move it to its open position. This allows the compression spring to expand which pushes upward on the spline lock, releasing the meshed teeth of the spline lock and the housing cap from each other. With the teeth released from each other, the spool is able to rotate, which winds the flexible barrier onto the spool.

The invention claimed is:

1. A retractable safety gate comprising:

a flexible barrier sheet extensible between two gateposts and windably disposed about a spool having a top end and a bottom end;

a winding spring operatively connected to the bottom end of the spool to apply continuous torque on the spool;

a cap mounted on the top end of the spool;

a cylindrical spline lock formed with a circumferential toothed outer edge and positioned within the cap and rotatably attached to the top of the spool;

a spline geometry disposed within or mounted on the spool and operatively connected with the spline lock to move the spline lock axially in relation to the spool upon application of pressure; and a locking mechanism including a stationary bracket positioned within the cap and having housing teeth formed and positioned to engage and disengage the circumferential toothed outer edge of the spline lock, a lever actuated cam mechanism mounted above the spline lock and rotatable between an unlocked position which disengages the housing teeth from the circumferential toothed outer edge of the spline lock and a locked position which engages the housing teeth with the circumferential toothed outer edge of the spline lock, and a lever operable connected to the cam mechanism and rotatable between an unlocked, upward position and a locked, downward position.

2. The retractable safety gate according to claim 1 further comprising a compression spring positioned within the cap so as to apply upward pressure on the spline lock when the lever is in the upward unlocked position.

3. The retractable safety gate according to claim 2 in which the spool is disposed within a spool housing having a longitudinal slit for permitting extension and retraction of the barrier sheet.

4. The retractable safety gate according to claim 3 further comprising a gate post having flanged sides, and wherein the longitudinal slit of the spool housing slidably receives the flanged gate post.

5. The retractable safety gate according to claim 4 further comprising a second gate post and in which the extending edge of the barrier sheet is formed with an engagement head and the second gate post is formed to removably receive the engagement head to temporarily position the barrier in its extended across the passageway.

6. A retractable safety gate comprising:

a flexible barrier sheet extensible between two gateposts and windably disposed about a spool having a top end and a bottom end;

a spool housing containing the spool and formed with a longitudinal slit;

a gate post having side flanges, wherein the longitudinal slit of the spool housing slidably receives the flanged gate post;

a winding spring operatively connected to the bottom end of the spool to apply continuous torque on the spool;

a cap mounted on the top end of the spool;

a cylindrical spline lock formed with a circumferential toothed outer edge and positioned within the cap and rotatably attached to the top of the spool;

a spline geometry disposed within or mounted on the spool and operatively connected with the spline lock to move the spline lock axially in relation to the spool upon application of pressure; and a locking mechanism comprising a stationary bracket positioned within the cap and having housing teeth formed and positioned to engage and disengage the circumferential toothed outer edge of the spline lock, a lever actuated cam mechanism mounted above the spline lock and rotatable between an unlocked position which disengages the housing teeth from the circumferential toothed outer edge of the spline lock and a locked position which engages the housing teeth with the circumferential toothed outer edge of the spline lock, and a lever operable connected to the cam mechanism and rotatable between an unlocked, upward position and a locked, downward position.

7. The retractable safety gate according to claim 6 further comprising a compression spring positioned within the cap so as to apply upward pressure on the spline lock when the lever is in the upward unlocked position.

8. The retractable safety gate according to claim 7 further comprising a second gate post and in which the extending edge of the barrier sheet is formed with an engagement head and the second gate post is formed to removably receive the engagement head to temporarily position the barrier in its extended across the passageway.

9. A retractable safety gate comprising:

a flexible barrier sheet extensible between two gateposts and windably disposed about a spool having a top end and a bottom end;

a spool housing containing the spool and formed with a longitudinal slit;

a gate post having side flanges, wherein the longitudinal slit of the spool housing slidably receives the flanged gate post;

a winding spring operatively connected to the bottom end of the spool to apply continuous torque on the spool;

a cap mounted on the top end of the spool;

a cylindrical spline lock formed with a circumferential toothed outer edge and positioned within the cap and rotatably attached to the top of the spool;

a spline geometry disposed within or mounted on the spool and operatively connected with the spline lock to move the spline lock axially in relation to the spool upon application of pressure;

a locking mechanism comprising a stationary bracket positioned within the cap and having housing teeth formed and positioned to engage and disengage the circumferential toothed outer edge of the spline lock, a lever actuated cam mechanism mounted above the spline lock and rotatable between an unlocked position which disengages the housing teeth from the circumferential toothed outer edge of the spline lock and a locked position which engages the housing teeth with the circumferential toothed outer edge of the spline lock, and a lever operable connected to the cam mechanism and rotatable between an unlocked, upward position and a locked, downward position, and a compression spring positioned within the cap so as to apply upward pressure on the spline lock when the lever is in the upward unlocked position; and a second gate post and in which the extending edge of the barrier sheet is formed with an engagement head and the second gate post is formed to removably receive the engagement head to temporarily position the barrier in its extended across the passageway.

* * * * *